US008079476B2

(12) United States Patent
Simms et al.

(10) Patent No.: US 8,079,476 B2
(45) Date of Patent: Dec. 20, 2011

(54) CORNER POST STRUCTURE FOR PACKAGING

(76) Inventors: Walter Brian Simms, Calhoun, GA (US); Joel Wayne Cram, Ooltewah, TN (US)

( * ) Notice: Subject to any disclaimer, the term of this patent is extended or adjusted under 35 U.S.C. 154(b) by 0 days.

(21) Appl. No.: 12/384,677

(22) Filed: Apr. 8, 2009

(65) Prior Publication Data

US 2010/0187153 A1 Jul. 29, 2010

Related U.S. Application Data

(60) Provisional application No. 61/205,903, filed on Jan. 26, 2009.

(51) Int. Cl.

| | |
|---|---|
| ***B65D 81/02*** | (2006.01) |
| ***B65D 85/30*** | (2006.01) |
| ***A47B 95/00*** | (2006.01) |

(52) U.S. Cl. ..... 206/586; 206/453; 248/345.1

(58) Field of Classification Search ..... 206/453, 206/586; 248/345.1; D8/403; 52/287.1
See application file for complete search history.

(56) References Cited

U.S. PATENT DOCUMENTS

| | | | | |
|---|---|---|---|---|
| RE19,121 | E * | 3/1934 | Schario | 206/453 |
| 3,049,260 | A * | 8/1962 | Stone | 206/586 |
| 3,433,354 | A * | 3/1969 | Liebel | 206/586 |
| 4,202,449 | A * | 5/1980 | Bendt | 206/453 |
| 4,244,471 | A * | 1/1981 | Plante | 206/586 |
| 5,799,797 | A * | 9/1998 | Braun | 206/586 |
| 5,899,046 | A * | 5/1999 | Hughes | 206/586 |
| 6,186,329 | B1 * | 2/2001 | Qiu | 206/586 |
| 6,527,119 | B1 * | 3/2003 | Markert et al. | 206/453 |
| 6,629,608 | B2 * | 10/2003 | Hurley et al. | 206/586 |
| 7,383,952 | B2 * | 6/2008 | Kruelle et al. | 206/453 |

* cited by examiner

*Primary Examiner* — Bryon Gehman
(74) *Attorney, Agent, or Firm* — Armstrong Teasdale LLP

(57) ABSTRACT

An improved article of manufacture for corner post construction having multiple, independent or related layers of material formed together into a wave pattern, comprised of semicircles, triangles, flat spots, squares or any other geometrical shape.

17 Claims, 2 Drawing Sheets

CORNER POST STRUCTURE FOR PACKAGING

CROSS REFERENCE TO RELATED APPLICATIONS

This is based on the provisional application for patent Ser. No. 61/205,903, filed Jan. 26, 2009, titled Wave Corner Post.

BACKGROUND OF THE INVENTION

1. Field of the Invention

This patent relates to a corner post not of the typical tubular type to be used to cushion and protect packaged articles, such as furniture or large appliances. More particularly, this patent relates to an improved non-tubular type corner post configured into a wave pattern.

2. Description of the Related Art

Conventional tubular type corner posts are made by cutting the paper to a desired length, then applying adhesive to the paper, and winding the coated paper around a mandrel to form one or more cylindrical tubes having a substantially circular cross-section, sliding the wound paper tubes onto a forming tool while the tubes are still malleable, forming the tubes into a desired shape, and allowing the adhesive between the paper layers to set up and form the finished product.

Gardner U.S. Pat. No. 4,483,444 discloses a corner post having a cross-sectional profile that accommodates overhang of the post relative to a bottom board without substantially reducing the resistance of the post to compressive forces. This tubular type corner post has a cross-sectional profile that is constant along the height of the post.

Hughes U.S. Pat. No. 5,267,651 discloses a corner post having laterally directed stiffening beads extending at an acute angle into free engagement with the opposite wall. When subjected to sufficient lateral force, the beads collapse onto themselves forming intermediate layers between the inner and outer walls.

Qiu et al. U.S. Pat. No. 6,186,329, discloses a laminated corner post made from multiple sheets of paper. Like all prior art corner posts described above, the Qiu corner post has an inner and outer wall surface.

While each of these prior art corner posts are useful for their particular purpose, none have a wave pattern configuration, which substantially increases the top to bottom compression strength with a lesser amount of fiber being used. In addition, none have the high level of flexibility to change the paper grades or leg widths that this new wave design has. This configuration does not use the standard tubular design, which provides it with a higher level of flexibility in adjusting leg lengths without additional mandrels or any other special set-up tooling.

Thus, it is an objective of the present invention to provide a laminated corner post having this wave pattern for creating a substantial increase in compression strength, the flexibility of changing paper grades and a simpler way to change leg lengths.

SUMMARY OF THE INVENTION

This invention relates to packaging, and more particularly to an article of manufacture for corner post construction. By having multiple, independent layers of material formed together into a wave pattern, a non-tubular apparatus has been created. This apparatus does not have inner and outer walls contained. The independent layers can be comprised of semicircles, triangles, flat spots, squares or any other geometrical shape contrived to place more material along the longitudinal axis. This invention has only two surfaces exposed from the materials being laminated together, which are the inside and outside surfaces.

This design is not of the wound paperboard tube type, nor is it simply laminated plies of paperboard formed into angled corner protectors. This invention is a combination of these types. It uses some of the benefits of each and creates a much stronger product in compression strength while still providing cushion protection.

The additional compression strength realized from this wave design not only prevents damage to contained products when stacked, but also allows for greater flexibility in materials used to maintain adequate compression strength. Lateral forces are evenly dispersed due to the wave design being flexible and having 50% less surface area in direct contact with the product contained, which makes this design much more favorable than the previously mentioned designs.

Certain prior patents have involved laminated paperboard mostly in a squared configuration, traditionally known as V-board. Other patents have covered paperboard tubes formed into shapes and even plain corrugated paperboard. These have all served their intended purposes to some degree and have performed well. However, certain characteristics of each of these products combined can provide a stronger and more economical corner post.

Laminated paperboard corner protectors or V-board have lacked adequate stacking strength and cushion protection, as they are rigid and thin. This wave pattern creates a cushioning affect when side impact occurs, allowing forces to be gently and evenly distributed. As shown in FIG. 1*b*, with less surface area in direct contact with the product contained, this wave design reduces the area of product at risk to side impact damage.

The wound paperboard tube industry uses corner protectors that contain inner and outer walls with a few sections of support (beads) for compression strength. However, this wave design structure requires less paper to achieve greater compression strength than most of these products that are found on the market.

Repeated test results have confirmed that less paperweight of this design, yields greater than a 30% increase in compression strength over conventionally wound paperboard tube type corner posts.

DETAILED DESCRIPTION OF INVENTION

Turning to the drawings, the corner post is made by applying adhesive to the paper. Then while the layers of paper are still malleable, it is to be formed into the shape of FIG. 1 which can be comprised of semicircles, triangles, flat spots, squares or any other geometrical shape, and allowing the adhesive between the paper layers to set up and form the finished wave pattern corner post.

Typically, corner posts are placed at each corner of an article between the product and the inside corners of the package. The corner posts protect the article against vertical (axial) and horizontal (lateral) forces. After manufacture, a product (typically a large appliance) is placed on or fastened to a pallet or base having dimensions greater than the width and depth of the appliance to accommodate corner posts. A protective sleeve, typically made of paperboard or corrugated board, is placed over the appliance to form the four sidewalls of the container. The corner posts are placed at each corner around the appliance and between the product and protective sleeve.

At this point, a paperboard or corrugated top is placed over the package. Straps may be placed around the container to better secure the corner posts between the appliance and the container. The packaged appliances may then be stacked on top of each other for warehousing.

We have developed a unique corner post using a wave design that can be formed of multiple sheets of paper of varying grades and widths allowing for a wide variety of possibilities to meet performance needs, or also for varying the frequency of the wave patter. Another possibility is shown in FIG. 3 as a lateral type compression post with a first standoff foot 10 and a second standoff foot 12 used to elevate the post.

In addition, most corner posts are commonly made with sides set at right angles as seen in FIG. 1. However, this design can be formed with extraordinarily long leg lengths and/or varying leg lengths which are adjusted to meet particular performance needs, but not limited to right angles.

While the embodiment described above is a multiple paper corner post varying in grades and widths, it is understood that other types of posts may be made according to this invention. It is anticipated that a wave configuration not formed at right angles be formed according to this invention to achieve the same benefits in compression strength, side impact protection and to further reduced the weight of paper being used.

Further modifications and alternative embodiments of the invention are contemplated, which do not depart from the spirit and scope of the invention as defined by the foregoing teachings and appended claims. It is intended that the claims cover all such modifications that fall within their scope.

The present invention is an improved corner post construction for supporting and cushioning contained products. The corner post has multiple layers of material formed together into a wave pattern, which can be comprised of any geometrical shape contrived to place more material along the longitudinal axis without creating a tubular type apparatus which contains an inner and outer wall, but merely having two surfaces exposed from the lamination of the materials being used.

The corner post is made from material comprising a means, which includes varying layer sheet widths, and/or varying amounts of layers contained within said corner post, which can be made of a lesser grade material to reduce costs and adjust compression strengths to accommodate different application specifications.

The varying processes of manufacture for this corner post design can be realized by anyone skilled in the arts as an item that can be conjoined in the longitudinal direction for a continuous web type flow operation and cut to length, laid up as individually cut sheets compiled independently or even folded into layered positions from a single sheet to be formed into said wave pattern.

Other objects and advantages will become apparent from the following descriptions, which are taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

This new corner post design, described as being used for the packaging industry, can be made from multiple or independent layers of material formed together into a wave pattern consisting of any geometrical shape imaginable to place more material along the longitudinal axis without creating a tubular type apparatus which has a hollow area contained within inner and outer walls.

It is further stated that by changing the width of the material layers, the leg lengths can be adjusted to accommodate different design requirements and is used to further regulate the compression strength characteristics desired. The use of different paper grade materials can further increase the flexibility in design changes without having to splice the different paper grades into their respective positions.

These layers of material can be laminated together as a web type operation from roll stock or laid up as sheets and even folded from a single source during the forming process.

Figure 1:
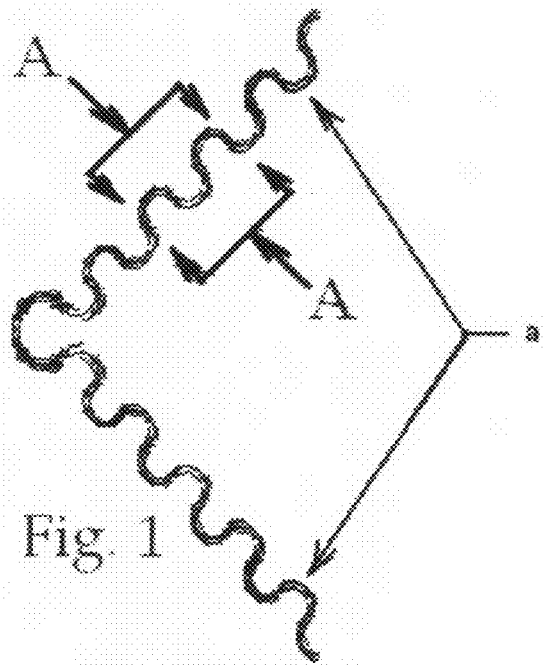
FIG. 1 is a top plan view of the invention showing the open inside corner FIG. 1*a* and the formed wave design. The detail A-A in FIG. 1 shows the direction of lateral forces and how the cushioning affect is provided.
Figure 2:
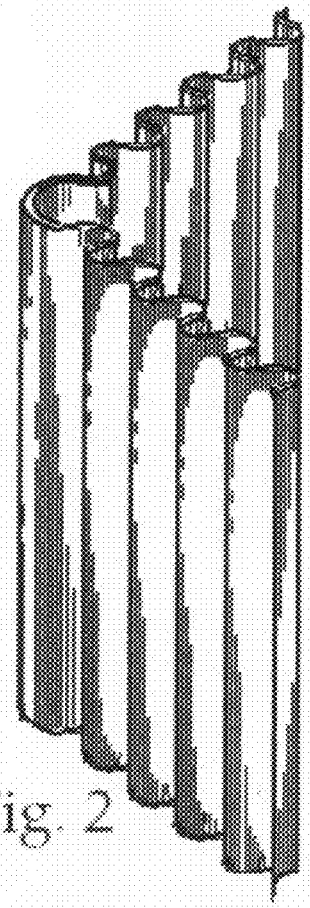
FIG. 2 is a perspective view of the invention standing on end and showing the full length.
Figure 3:
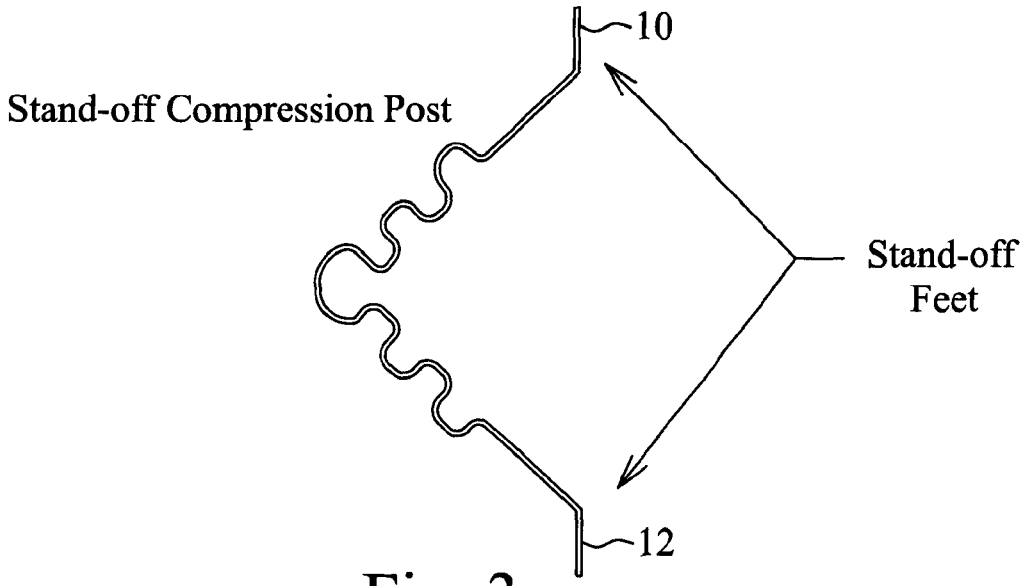
FIG. 3 is a top plan view of a Stand-off Compression Post as described.
Figure 4:
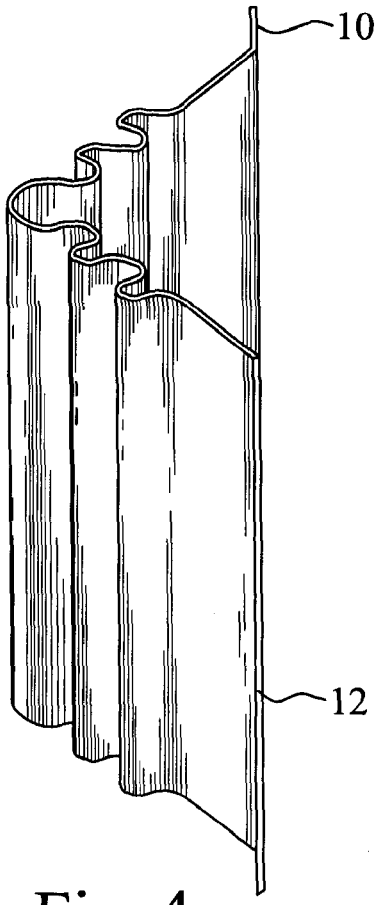
FIG. 4 is a perspective view of a Stand-off Compression Post standing on end and showing the full length.

Once formed into the wave pattern, a cushioning affect is created when lateral forces are applied to the product package, which evenly distributes the forces along the sides and a void area is provided as shown in FIG. 1*a*, at the inside corner for further protection of the very corner of the product corner itself. This minimum area in direct contact with the product contained further reduces the area exposed to damage from lateral forces and also reduces the surface area in which abrasion coatings might be required.

By adjusting the frequency of the wave pattern, more or less material may be placed along the longitudinal axis for an increase in compression strength or a reduction in the amount of materials being used to achieve a desired, compression strength to paper weight ratio.

While the invention has been described in connection with a preferred embodiment, it is not intended to limit the scope of the invention to the particular form set forth. On the contrary, it is intended to cover such alternatives, modifications, and equivalents as may be included within the spirit and scope of the invention as defined by the appended claims.

What is claimed is:

1. A corner post structure for packaging, the corner post structure comprising multiple layers of sheet material laminated together into a wave pattern, the wave pattern comprising alternating arcuate structures defining a first leg, a second leg, and a corner void area, the multiple layers of sheet material defining a first exposed surface and a second exposed surface, each surface defining a continuous arcuate portion of the wave pattern, the first exposed surface and the second exposed surface opposing each other, wherein the wave pattern of the first exposed surface and the corner void area facilitate minimizing contact between the first exposed surface and an adjacent product.

2. The corner post structure according to claim 1 wherein the multiple layers of sheet material comprise multiple grades of materials to achieve a compression strength for the corner post construction, wherein the multiple layers of sheet material are not spliced end to end.

3. The corner post structure according to claim 1 wherein the multiple layers of sheet material are conjoined in a longitudinal direction of a continuous web of the sheet material and formed into the wave pattern.

4. The corner post structure according to claim 1 wherein the multiple layers of sheet material are conjoined as individual sheets that are one of laid up as a whole, and laid up independently and then formed into the wave pattern.

5. The corner post structure according to claim 1 wherein the multiple layers of sheet material are conjoined as folded sheets from a single supply source and formed into the wave pattern.

6. The corner post structure according to claim 1 wherein the wave pattern is configured to provide a cushioning affect to lateral forces, wherein the corner post structure does not include an internal hollow area between adjacent layers of the multiple layers of sheet material.

7. The corner post structure according to claim 1 wherein a peak of each wave of the wave pattern of one of the first exposed surface and the second exposed surface is configured to contact with a product positioned adjacent the corner post structure.

8. The corner post structure according to claim 1 wherein the multiple layers of sheet material comprise sheets of various widths.

9. The corner post structure according to claim 1 further comprises a corner connection structure connected to the first leg and the second leg to define a V-shaped cross-sectional shape, and wherein the connection structure at least partially defines the corner void area.

10. A corner post structure having a generally V-shaped cross-sectional shape, said corner post structure comprising:

a first leg comprising a first series of alternating arcuate structures that define a first wave pattern having opposed exposed arcuate surfaces of the first leg each defining the first wave pattern;

a second leg comprising a second series of alternating arcuate structures that define a second wave pattern having opposed exposed arcuate surfaces of the second leg each defining the second wave pattern; and a connection structure connecting the first leg and the second leg to define the generally V-shaped cross-sectional shape, the connection structure integrated into the first wave pattern and the second wave pattern and defining a corner void area, wherein the first leg, the second leg, and the connection structure are formed from a continuous sheet of material comprising a plurality of layers of material laminated together, and wherein the alternating arcuate structures of said corner post structure facilitate minimizing contact between the exposed surfaces and an adjacent product.

11. The corner post structure according to claim 10 wherein the plurality of layers of material comprises a plurality of layers of paper sheet material.

12. The corner post structure according to claim 11 wherein the plurality of layers of paper sheet material comprises paper sheets having at least one of varying grades and varying widths.

13. The corner post structure according to claim 10 further comprises a first foot extending from the first leg and a second foot extending from the second leg, the first foot and the second foot comprising a substantially flat portion.

14. The corner post structure according to claim 13 wherein the first foot and the second foot are formed integrally with the first leg, the second leg, and the connection structure from the continuous sheet of material.

15. A method for forming a corner post structure for packaging, the corner post structure including a plurality of layers of material, said method comprising:

applying adhesive to at least one layer of material of the plurality of layers of material;

forming the plurality of layers of material into a continuous sheet of material defining opposed exposed surfaces;

shaping the continuous sheet of material to include a first leg having a first series of alternating arcuate structures that define a first wave pattern having both exposed surfaces of the first leg defining the first wave pattern, a second leg having a second series of alternating arcuate structures that define a second wave pattern having both exposed surfaces of the second leg defining the second wave pattern, and a connection structure connecting the first leg and the second leg and integrated into the first wave pattern and the second wave pattern, the connection structure defining a corner void area, wherein the alternating arcuate structures facilitate minimizing contact between the exposed surfaces and an adjacent product; and setting the adhesive to form the corner post structure having a generally V-shaped cross-sectional shape.

16. The method according to claim 15 wherein forming the plurality of layers of material into a continuous sheet of material further comprises conjoining one of a plurality of layers of material that are laid up as a whole and a plurality of layers of material that are laid up independently.

17. The method according to claim 15 wherein forming the plurality of layers of material into a continuous sheet of material further comprises conjoining folded sheets from a single supply source into the continuous sheet of material.

* * * * *